US009976370B2

(12) United States Patent
Boleyn, Jr.

(10) Patent No.: US 9,976,370 B2
(45) Date of Patent: May 22, 2018

(54) DUMP BAILER ACTUATOR

(71) Applicant: Michael Wayne Boleyn, Jr., Lafayette, LA (US)

(72) Inventor: Michael Wayne Boleyn, Jr., Lafayette, LA (US)

( * ) Notice: Subject to any disclaimer, the term of this patent is extended or adjusted under 35 U.S.C. 154(b) by 250 days.

(21) Appl. No.: 14/978,248

(22) Filed: Dec. 22, 2015

(65) Prior Publication Data

US 2017/0175471 A1 Jun. 22, 2017

(51) Int. Cl.

| | |
|---|---|
| ***E21B 27/02*** | (2006.01) |
| ***E21B 34/06*** | (2006.01) |
| ***E21B 4/04*** | (2006.01) |

(52) U.S. Cl.

CPC ..... *E21B 27/02* (2013.01); *E21B 4/04* (2013.01); *E21B 34/063* (2013.01)

(58) Field of Classification Search

CPC ..... E21B 27/02; E21B 4/04; E21B 34/063; E21B 27/00; E21B 23/04; E21B 33/134

See application file for complete search history.

(56) References Cited

U.S. PATENT DOCUMENTS

| | | | | | |
|---|---|---|---|---|---|
| 2,141,179 | A * | 12/1938 | Ennis | E21B 27/02 | 137/624.11 |
| 2,572,493 | A * | 10/1951 | Klaasen | E21B 27/02 | 166/165 |
| 2,618,345 | A * | 11/1952 | Tucker | E21B 27/02 | 166/117 |
| 2,896,723 | A * | 7/1959 | Barnes | E21B 27/02 | 166/166 |
| 3,650,325 | A * | 3/1972 | Owens | E21B 23/06 | 166/182 |
| 4,741,396 | A * | 5/1988 | Falxa | E21B 27/02 | 166/169 |
| 5,392,856 | A * | 2/1995 | Broussard, Jr. | E21B 23/06 | 166/169 |
| 8,813,841 | B2 | 8/2014 | Carisella | | |
| 9,284,804 | B2 * | 3/2016 | Lovik | E21B 27/02 | |
| 2011/0259607 | A1 * | 10/2011 | Carisella | E21B 23/04 | 166/381 |
| 2012/0160483 | A1 * | 6/2012 | Carisella | E21B 27/02 | 166/270 |

* cited by examiner

*Primary Examiner* — Yong-Suk Ro

(74) *Attorney, Agent, or Firm* — Law Office of Jesse D. Lambert, LLC

(57) ABSTRACT

A dump bailer actuator mechanism is disposed in a dump bailer having an elongated body and a longitudinal bore therethrough. The actuator mechanism has a collet rod which is moved longitudinally between a first, lower position and a second, upper position, by an electric motor turning a threaded shaft, on which rides a nut assembly connected to a push rod, which in turn contacts the collet rod. In the first, lower position, the collet rod keeps the collet fingers of a collet finger assembly, which have external shoulders, engaged with a shoulder profile within the bore of the main body. A weight bar assembly is attached to the collet finger assembly. When the collet rod is moved to the second, upper position, the collet fingers disengage from the profile, and the weight bar assembly is moved forcefully downward, striking a swab piston and forcing cement out of the dump bailer.

6 Claims, 6 Drawing Sheets

DUMP BAILER ACTUATOR

CROSS REFERENCE TO RELATED APPLICATIONS

Not applicable.

BACKGROUND

Field of the Invention

This invention relates to apparatus used in the servicing of oil, gas or other types of wells, referred to generally herein as "wells." In particular, this invention relates to apparatus used to place flowable materials, including but not limited to cement or other flowable materials, in a desired location downhole in a well.

Tools commonly known as "dump bailers" comprise an elongated main body having a bore therethrough and a cavity inside. A quantity of flowable material, which for exemplary purposes will be described as cement, is placed within the cavity or chamber. It is understood that other flowable materials may be placed within the cavity, for example sand, "gravel," possibly liquids such as resins, acid, or other materials. By way of example, a dump bailer may be used to deposit a quantity of cement across perforations, or atop a bridge plug or other mechanical device.

The dump bailer is usually run downhole on a wireline, whether electric line or "slickline" (which has no electrical conductor) into a well to a desired downhole location. Other embodiments can be run on coiled tubing. Most commonly, dump bailers are run on electric line. Once in place, a mechanism is operated, for example by electric current flow from the surface, to open ports, slots or other openings to "dump" the flowable material in place. In some dump bailers, the cement simply flows out under the influence of gravity. In other dump bailer designs, the cement is forced out of the cavity under the influence of a weight bar assembly striking a piston, which in turn transmits force through the cement volume to move a second piston, which exposes opening through which the cement flows, being forced out (at least to some degree) by the weight bar assembly, often driven by a spring.

Prior art dump bailers, especially those comprising the weight bar assembly described above, present various operational issues. In particular, the mechanisms, namely the "actuator assembly," which controls release of the the weight bar assembly, and hence the cement, have given rise to problems in well servicing. One type uses an explosive charge to release the weight bar assembly, with the attendant personnel safety issues and risks of premature detonation and triggering downhole, resulting in dumping cement in an undesired location. Radio silence is required while such tools are being run. Another type depends on a pressurized chamber mechanism to retain the tool in a cocked position; a leak in this mechanism can result in a premature triggering and dumping of cement. Such unplanned and undesired cement dumping can lead to an expensive remedial job (workover or recompletion), or in some cases loss of the well. It is readily understood that such events can result in tremendous cost to the operator of the well.

The known prior art dump bailer systems present this and other issues, giving rise to a desire for an improved dump bailer, particularly the release mechanism thereof, that addresses these issues.

SUMMARY OF THE INVENTION

The dump bailer comprising the principles of the present invention comprises an elongated main body having a longitudinal bore therethrough. An actuator mechanism is disposed in the bore, the actuator mechanism having a collet rod which is moved longitudinally between a first, lower position and a second, upper position, by an electric motor turning a threaded shaft, on which rides a nut assembly connected to a push rod, which in turn contacts the collet rod. In the first, lower position, the collet rod keeps the collet fingers of a collet finger assembly, which have external shoulders, engaged with a profile within the bore of the main body. A weight bar assembly is attached to the collet finger assembly. When the collet rod is moved to the second, upper position, the collet fingers move radially inward and the shoulder profiles on the collet fingers disengage from the shoulder profile within the main bore, and the weight bar assembly is moved forcefully downward, striking a swab piston and forcing cement out of the dump bailer.

DESCRIPTION OF THE PRESENTLY PREFERRED EMBODIMENT(S)

While various dump bailer actuator designs can embody the principles of the present invention, with reference to the drawings some of the presently preferred embodiments can be described.

Figure 1A:
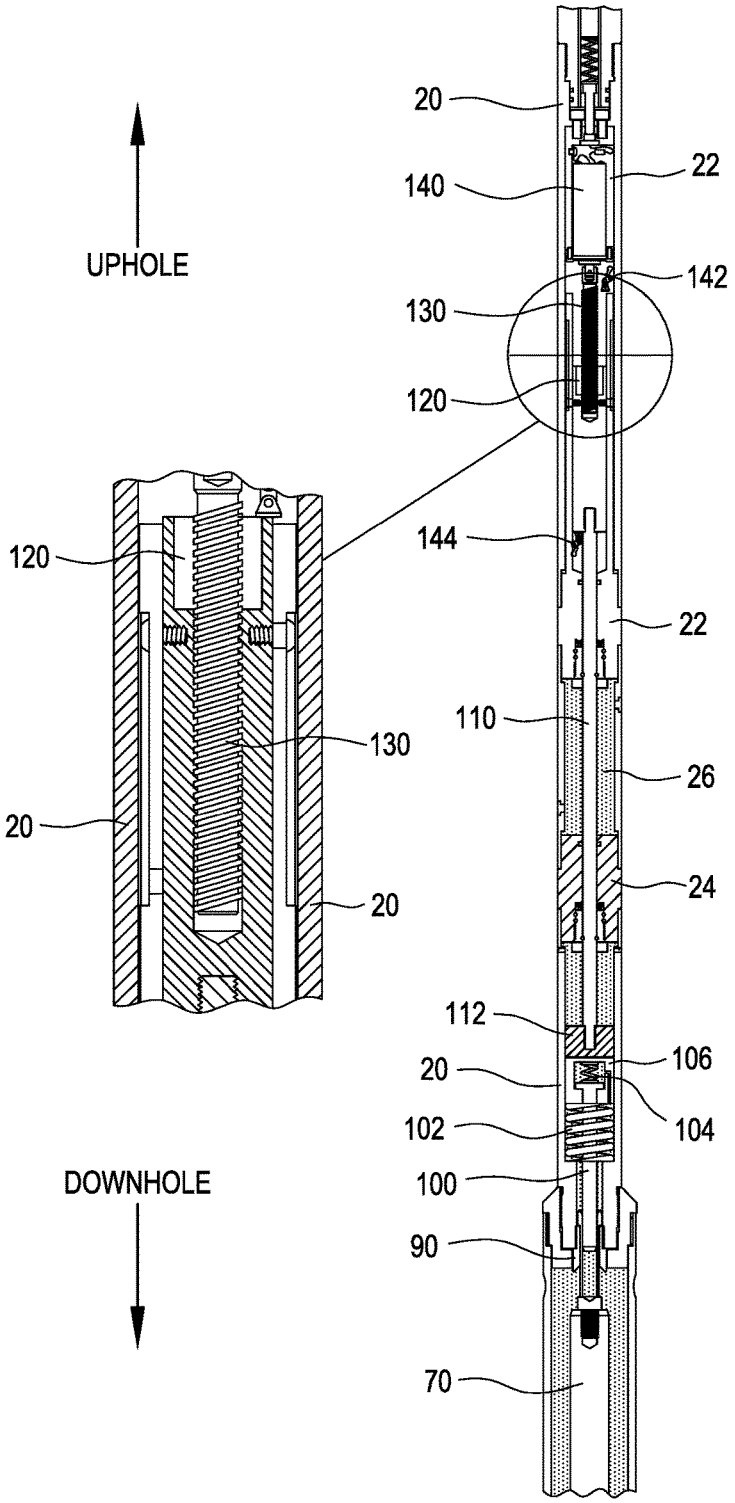
FIG. 1A is a cross section view of an upper (uphole) part of the dump bailer, more particularly the dump bailer actuator assembly, embodying the principles of the present invention, in a first operating position.
Figure 1B:
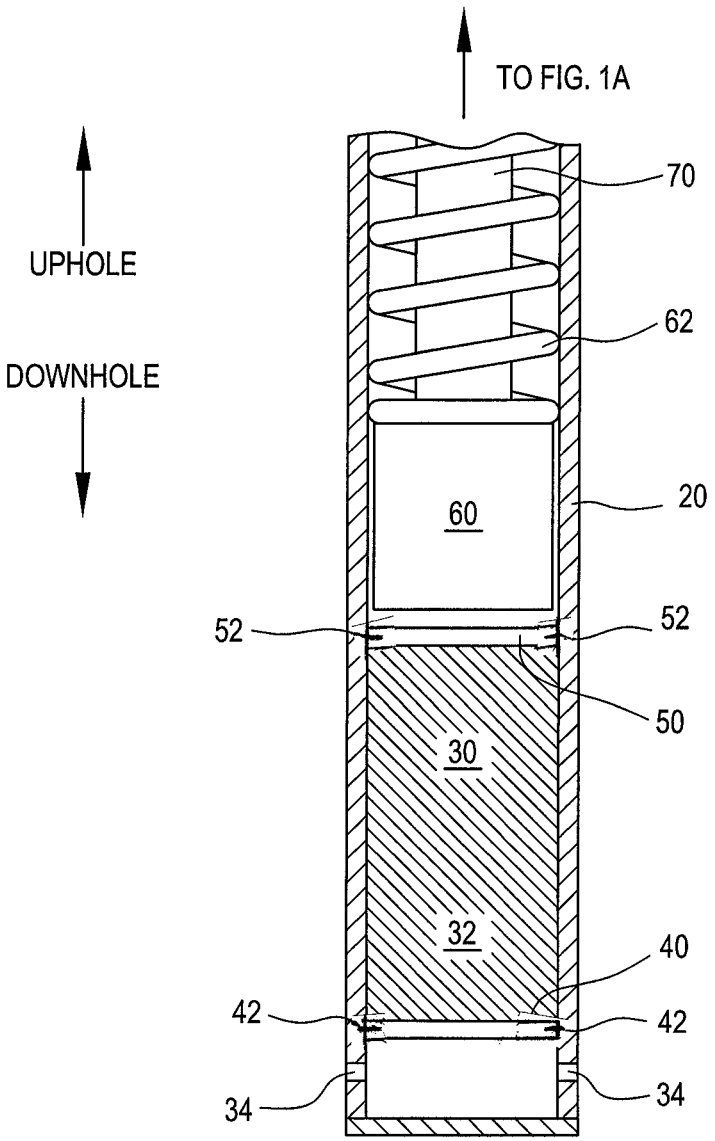
FIG. 1B is a cross section view of a lower (downhole) part of the dump bailer, which is understood to be a continuation of the dump bailer of FIG. 1, showing the cement (or other material) cavity and pistons.

FIGS. 1A and 1B are cross section views of a dump bailer 10 comprising the principles of the present invention. It is to be understood that FIG. 1A shows an upper section of dump bailer 10, while FIG. 1B is a continuation of FIG. 1A, in a downward or downhole direction, showing a lower section of dump bailer 10. That part of dump bailer 10 shown in FIG. 1B is shown primarily for background information only. Dump bailer 10 comprises an elongated main body 20 having a longitudinal bore 22 therethrough. As can be seen in FIG. 1B, main body 20 comprises a cavity 30 in its lower section, in which can be placed a flowable material 32, such as cement, chemicals, etc. for placement downhole by the dump bailer. A shear piston 40 is held in place by a shear element 42, which may be a shear screw or pin. Swab piston 50 is held in place by a shear element 52, which may be a shear screw or pin. Before actuation of the dump bailer actuator, shear piston 50 and swab piston 40 are in the positions shown in FIG. 1B, with shear piston 50 above openings 34. Upon actuation of the dump bailer actuator, as later described, swab piston 40 is forcefully struck by a weight bar assembly (which may comprise weight bar 60 and weight bar extension 70, along with spring 62 which assists in driving the weight bar assembly downward against swab piston 50), which in turn shears shear elements 52 and 42, moving shear piston 40 to a position below openings 34, and forcing flowable material out through openings 34.

Figure 2:
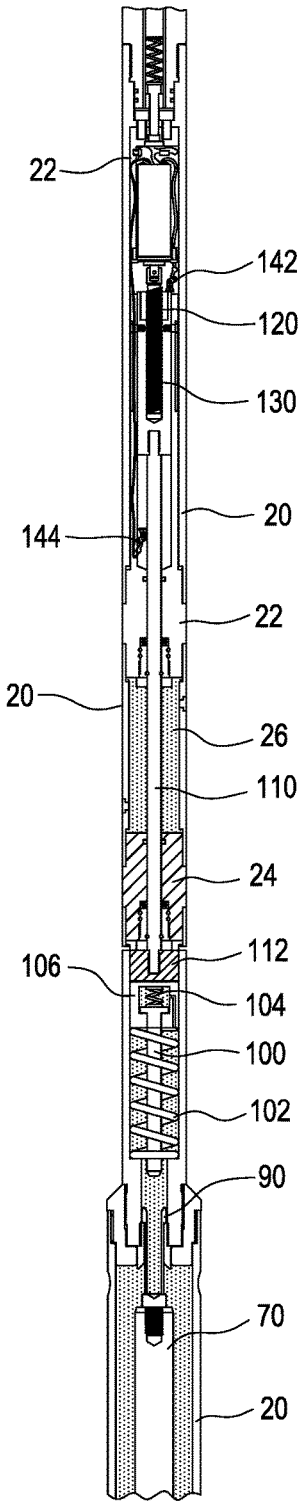
FIG. 2 is a cross section view of an upper (uphole) part of the dump bailer, more particularly the dump bailer actuator assembly, similar to that shown in FIG. 2, embodying the principles of the present invention, in a second operating position.
Figure 3:
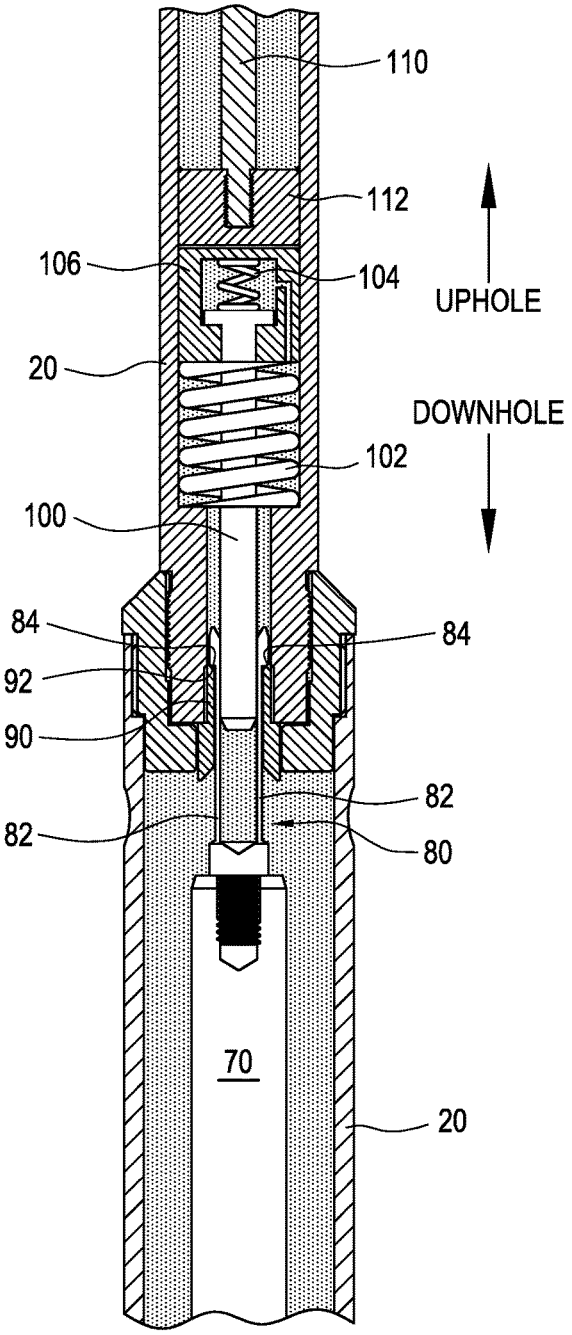
FIG. 3 is a more detailed cross section view of a portion of the actuator assembly, in the position corresponding to FIG. 1A.
Figure 4:
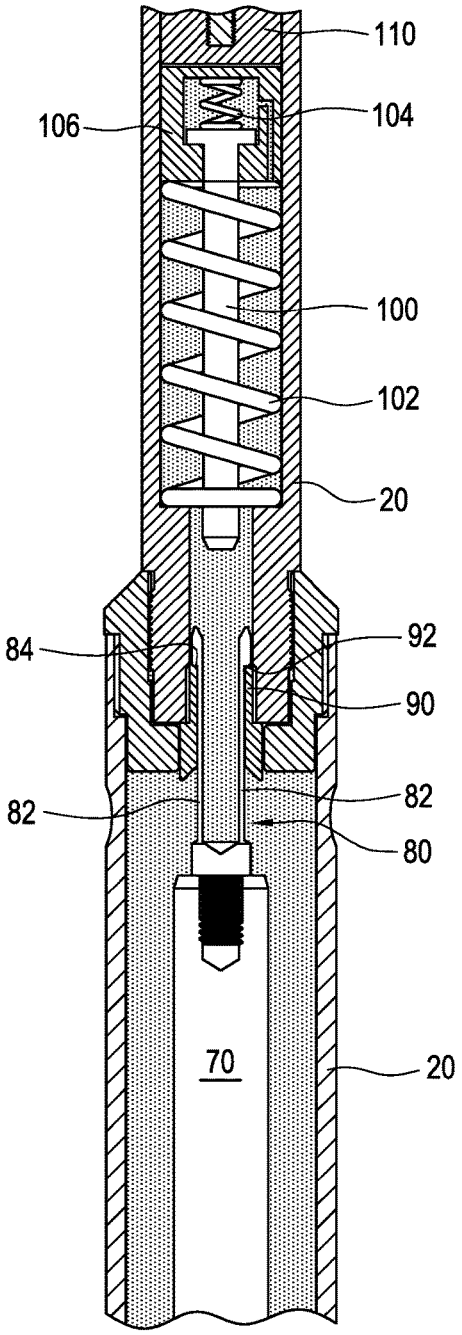
FIG. 4 is a more detailed cross section view of a portion of the actuator assembly, in the position corresponding to FIG. 2.

Referring to FIGS. 1A and 3 (FIG. 3 being a more detailed view of a portion of FIG. 1A), dump bailer 10, or more specifically the actuator thereof, is shown in a first position, before actuation, with collet rod 100 in a first, lower position. It is to be understood that "lower" is toward the downhole direction, as the apparatus is typically disposed in a wellbore; "upper" is toward the uphole direction. A rotary drive means 140, which may be an electric motor driven by electric current from the surface or from a downhole battery, is connected to and turns a threaded shaft 130. Engaged on the threaded shaft 130 is a nut assembly 120, which as can be readily understood has a bore with female threads therein. Rotation of threaded shaft 130 in one direction moves nut assembly 120 in a downward (downhole) direction; reverse electric current flow, and consequently reverse rotation of threaded shaft 130, moves nut assembly in an upward (uphole) direction. As can be seen in FIGS. 1A, 2, 5, and 6, limit switches 142 and 144 control maximum movement of nut assembly 120 in each direction, shutting off electric current to rotary drive means 140 which the maximum travel is reached.

Connected to nut assembly 120 is a push rod 110, preferably terminating in an enlarged bull nose 112 at its lower end. Bull nose 112 bears against a collet rod cap 106, containing an upper spring 104, the collet rod cap 106 and upper spring 104 engaging a collet rod 100. A lower spring 102 bears against collet rod cap 106 and/or collet rod 100, biasing collet rod 100 in an upper (uphole) direction. As can be seen in FIGS. 1A and 2, push rod 110 extends through upper and lower subs 22 and 24, and a cavity 26 therebetween may be filled with a suitable lubricant, oil, etc. It is understood that appropriate seals, etc. permit push rod 110 to move longitudinally through upper and lower subs 22 and 24 in a sealed fashion, retaining any lubricant within cavity 26.

Referring to FIGS. 1A, 2, 3 and 4, a collet receiving area 90 is disposed within bore 22 of main body 20. A shoulder or profile 92 is positioned within collet receiving area 90.

A collet finger assembly 80 comprises a plurality of flexible collet fingers 82 (collet finger assembly 80 being shown in cross section, it being understood that the total number of collet fingers 82 generally forming a full circle), at least some of said collet fingers 82 having external shoulders 84 thereon. As will be later described, shoulders 84 engage shoulder profile 92 when collet finger assembly 80 is in an upper position.

Attached to collet finger assembly 80 is a weight bar extension 70, which connects to weight bar 60, previously described.

Operation of the Dump Bailer

Operation of the dump bailer can now be described, with reference to the figures.

Figure 5:
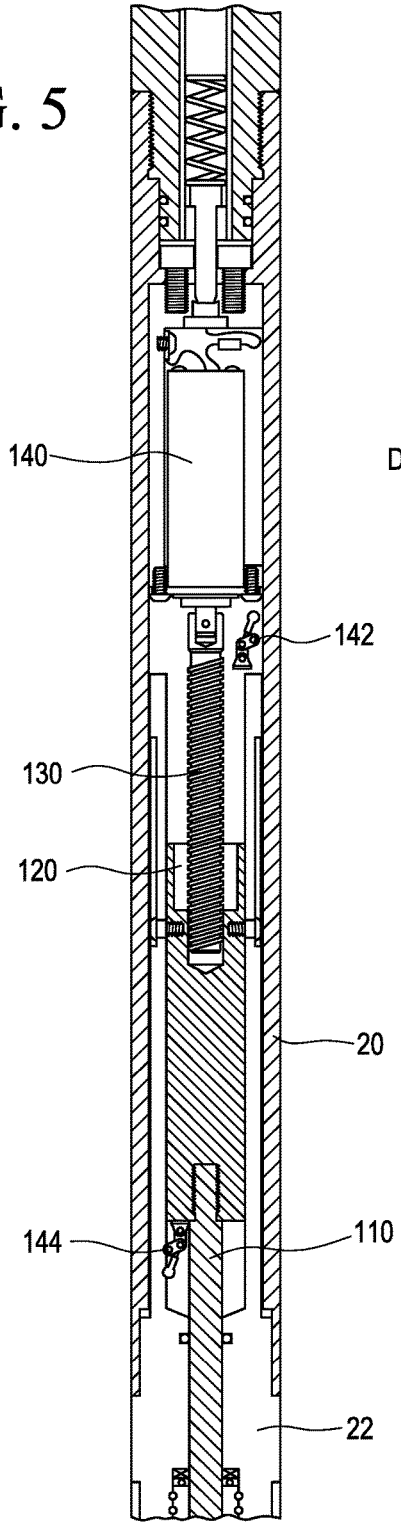
FIG. 5 is a more detailed cross section view of another portion of the actuator assembly, in the position corresponding to FIG. 1A.
Figure 6:
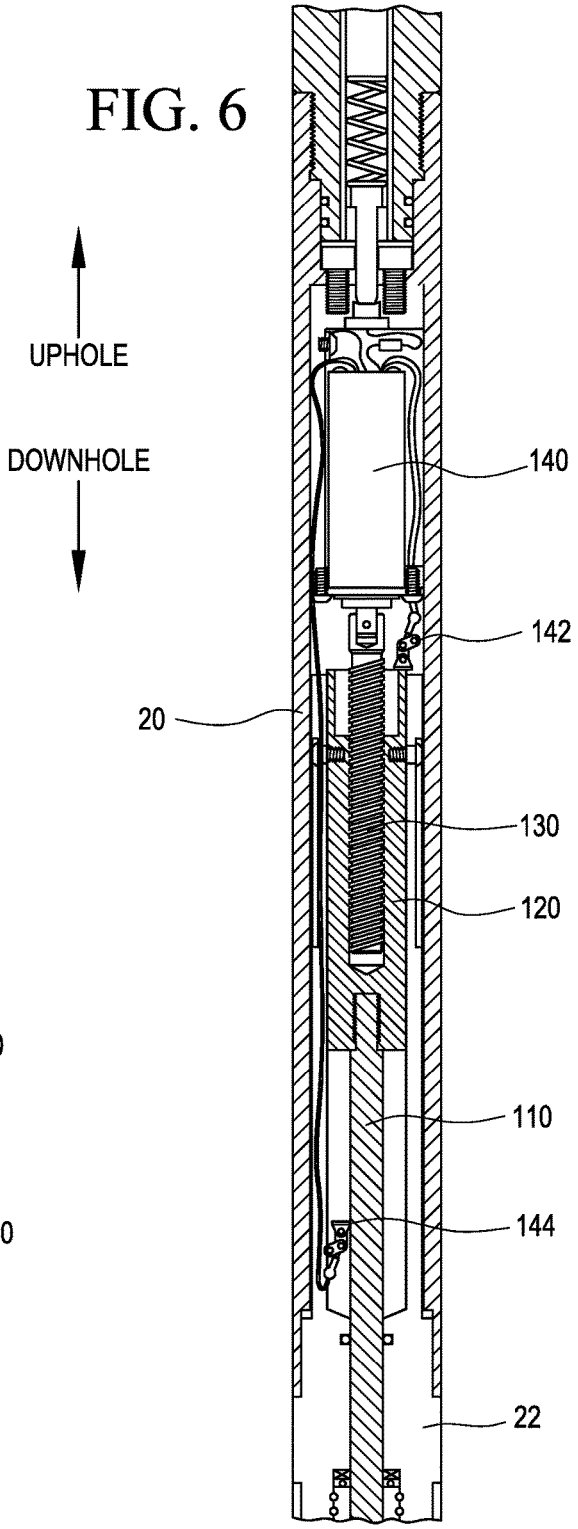
FIG. 6 is a more detailed cross section view of another portion of the actuator assembly, in the position corresponding to FIG. 2.
Figure 7:
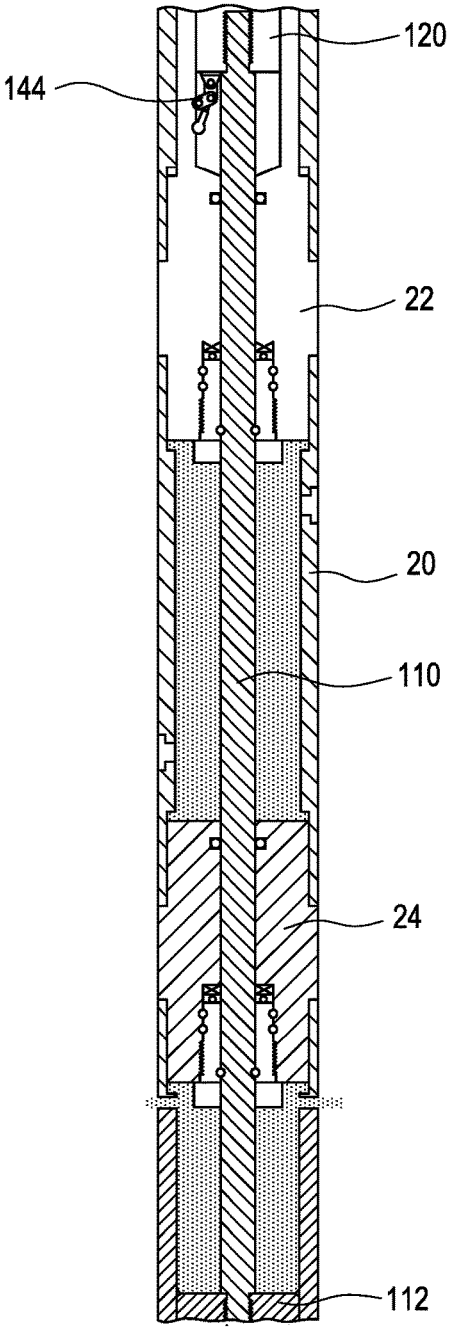
FIG. 7 is a more detailed cross section view of another portion of the actuator assembly, in the position corresponding to FIG. 1A.
Figure 8:
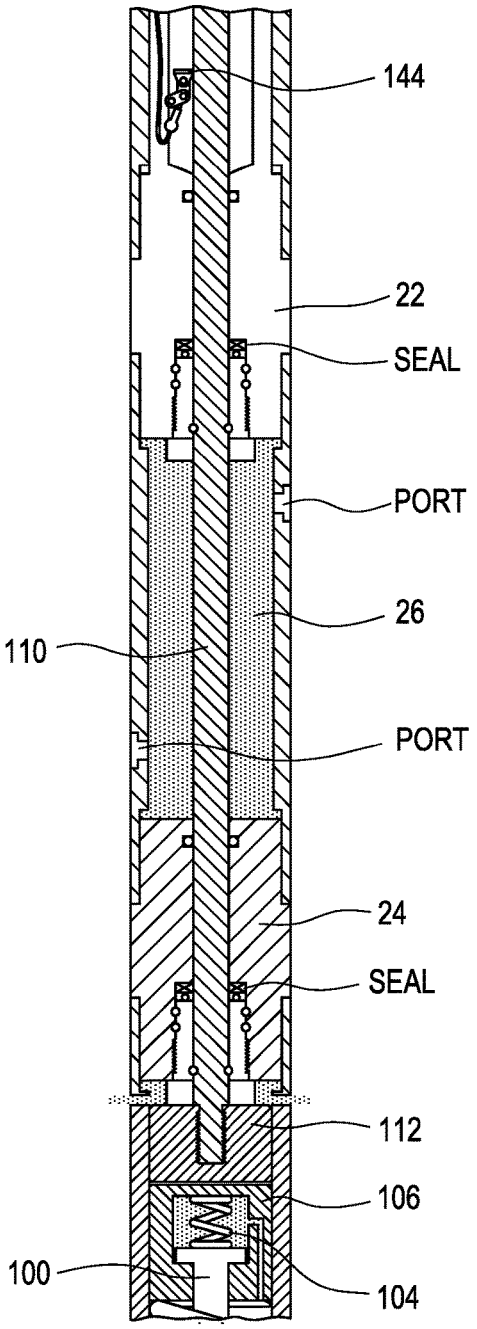
FIG. 8 is a more detailed cross section view of another portion of the actuator assembly, in the position corresponding to FIG. 2.

FIGS. 1A, 3 and 5 show the various elements of dump bailer 10 with collet rod 100 in a first, lower position, and the tool being prepared for lowering into a well for a dump bailer operation. Rotary drive means 140 is rotated in the appropriate direction so as to advance nut assembly 120, push rod and bull nose 110 and 112, and collet rod 100 (including collet rod cap 106 and upper spring 104) in a downward or downhole direction, to the position shown in those figures. As can be seen, collet rod 100 is disposed within collet receiving area 90 and across shoulder profile 92. Collet finger assembly 80 is positioned as shown in FIGS. 1A and 3, which may be done by "cocking" the weight bar assembly and moving it into positioned after collet rod 100 is disposed across shoulder profile 92; this usually permits feeling and/or hearing a "snap in" of collet fingers 82, namely shoulders 84, in shoulder profile 92. Alternatively, collet finger assembly 80 could be put into place with shoulders 84 engaged with shoulder profile 92, then collet rod 100 placed into its lower position. In this position, it is understood that collet rod 100 keeps collet fingers 82 displaced radially outward, so that shoulders 84 engage shoulder profile 92. In this position, collet finger assembly 80 and the attached weight bar extension 70 (and weight bar 60) cannot move downhole, due to the engagement of shoulders 84 and shoulder profile 92.

Dump bailer 100 can then be lowered, via electric line, wireline, coiled tubing or other means known in the art, to a desired downhole location in a well, namely where the cement or other flowable material is desired to be placed.

Once in the desired location, appropriate electric current flow is initiated through rotary drive means 140, namely an electric motor, turning threaded shaft 130 in the appropriate direction to move nut assembly 120, push rod 110 and bull nose 112 in an upward or uphole direction. Lower spring 102 biases collet rod 100 (and collet rod cap 106 and upper spring 104) in an upward or uphole direction, ultimately to the position shown in FIGS. 2, 4, and 6. Now, with collet rod 100 moved out of the collet receiving area 90, and out from across shoulder profile 92, collet fingers 82 in collet finger assembly 80, which are fabricated so as to ordinarily be flexed somewhat radially inward, are free to move slightly radially inward so that shoulders 84 come out of engagement with shoulder profile 92. This action is the "triggering" of the weight bar assembly. Collet finger assembly 80 is then pulled in a downward or downhole direction under the weight of weight bar 60 and spring 62. The entire assembly is then moved forcefully downward as earlier described, with the weight bar striking the swab piston 50, putting the flowable material into motion and forcing it to be deposited out of the tool.

It is understood that dump bailer 10 has appropriate means to connect same to an electric line, wireline, coiled tubing, etc., as well know in the art. Connectors, seals, etc. are employed as known in the art. Further, electric current may be supplied from the surface by electric conductors.

Materials used in fabrication of dump bailer 10 are those well known in the relevant art, including high strength steels and other metals, resilient materials for seals, etc.

An Alternate Embodiment

Figure 10:
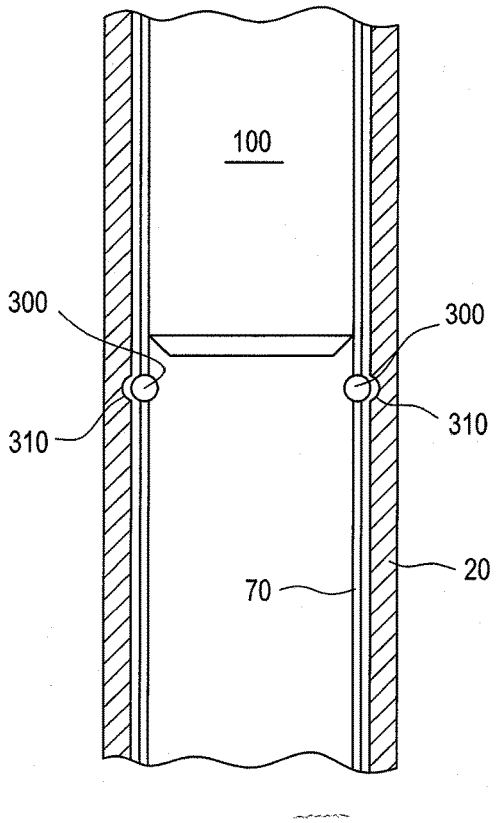
FIGS. 9 and 10 are views of a detent assembly.
Figure 9:
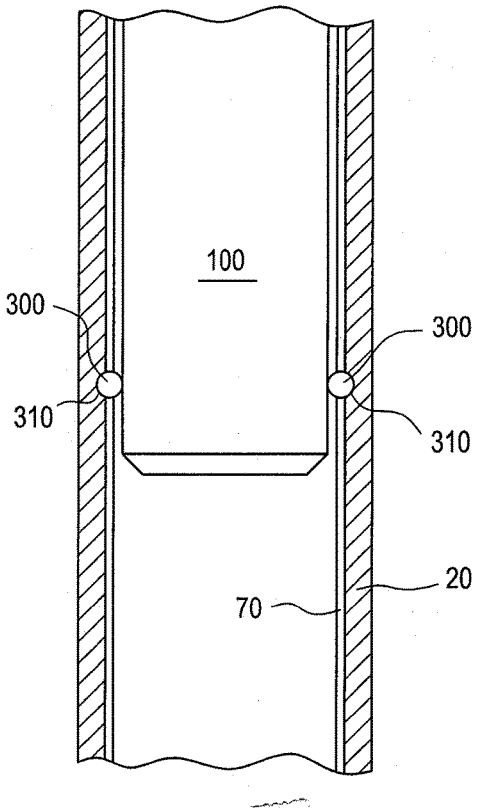

An alternate embodiment of the dump bailer comprising the principles of the present invention has a ball/detent assembly in lieu of the collet finger assembly described above. Referring to FIG. 9, a plurality of balls 300 are disposed within an upper end of weight bar extension 70, and when operating rod 100 (which is substantially the same as collet rod 100 previously described in connection with the first embodiment) is in its lower or downhole position, balls 300 are held radially outward and engaged with corresponding grooves 310 within the bore of main body 20. It can be readily understood that in that position, weight bar extension 70 and as a result the weight bar assembly are held in place. In FIG. 10, actuating rod 100 is moved to its upper position, and balls 300 are free to move radially inward and out of engagement with grooves 310, with the weight bar extension and attached weight bar assembly thereby free to move downward, as previously described.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions can be varied to suit particular applications. Materials may be changed to more particularly suit various settings. The rotary drive means may take various forms, including electric motors, hydraulic motors, pneumatic rotary means, or some combination thereof. In lieu of or in addition to providing electric current from a surface source via electric line, a downhole battery could be used to supply electric current, etc.

Therefore, the scope of the invention is to be determined not by the illustrative examples set forth above, but by the appended claims and their legal equivalents.

I claim:

1. A dump bailer, comprising:

an elongated main body adapted to be lowered into a wellbore, said main body having a longitudinal bore and a cavity in a lower portion, said cavity adapted to hold a quantity of flowable material;

a weight bar assembly slidably disposed in main body bore, an upper end of said weight bar assembly comprising a collet assembly comprising a plurality of flexible upwardly extending collet fingers adapted to move radially inward and outward, at least some of said collet fingers comprising an outer shoulder;

said bore of said main body comprising a collet receiving area having a shoulder profile within said collet receiving area, said shoulder profile adapted to engage said outer shoulder of said collet fingers;

a rotary drive means for rotating a threaded shaft disposed within said main body bore;

a threaded nut assembly disposed on said threaded shaft, with a push rod attached to said threaded nut assembly and extending downwardly;

a collet rod disposed within said bore below said push rod and longitudinally movable upwardly and downwardly;

whereby rotation of said threaded shaft in a first direction moves said threaded nut assembly longitudinally downward along said threaded shaft, said push rod moving with said threaded nut assembly, said push rod bearing against said collet rod and moving said collet rod to a first, lower position, wherein said collet rod is disposed within said collet receiving area, and when said collet finger assembly is also disposed within said collet receiving area said collet fingers are held radially outward by said collet rod, said outer shoulder of said collet fingers engaging said shoulder profile of said main body bore and longitudinally locking said collet assembly and said weight bar assembly in place;

whereby rotation of said threaded shaft in a second direction moves said threaded nut assembly longitudinally upward along said threaded shaft, said push rod moving upward, said collet rod moving upward under bias of a spring to a second, upper position, wherein said collet rod is above said collet receiving area, wherein said collet fingers move radially inward and said collet finger shoulders move out of engagement with said shoulder profile within said main body bore, said collet assembly and said weight bar assembly thereby free to move downward and force said flowable material out of said cavity.

2. The dump bailer of claim 1, wherein said rotary drive means comprises an electric motor.

3. The dump bailer of claim 1, further comprising a collet rod cap disposed over an upper end of said collet rod, and a spring disposed within said collet rod cap between said collet rod and said collet rod cap.

4. The dump bailer of claim 2, further comprising limit switches which stop electric current flow to said electric motor when said nut assembly reaches uphole and downhole travel limits.

5. A dump bailer, comprising:

an elongated main body adapted to be lowered into a wellbore, said main body having a longitudinal bore and a cavity in a lower portion, said cavity adapted to hold a quantity of flowable material;

a weight bar assembly slidably disposed in main body bore, said weight bar assembly comprising an upper end and a plurality of balls radially movable within said upper end;

said bore of said main body comprising one or more grooves in a lower section thereof, adapted to engage said balls;

a rotary drive means for rotating a threaded shaft disposed within said main body bore;

a threaded nut assembly disposed on said threaded shaft, with a push rod attached to said threaded nut assembly and extending downwardly;

an operating rod disposed within said bore below said pushrod and longitudinally movable upwardly and downwardly;

whereby rotation of said threaded shaft in a first direction moves said threaded nut assembly longitudinally downward along said threaded shaft, said push rod moving with said threaded nut assembly, said push rod bearing against said operating rod and moving said operating rod to a first, lower position, wherein said operating rod is disposed across said grooves, and when balls in said weight bar assembly are also disposed across from said grooves then said balls are held radially outward by said operating rod, said balls engaging said grooves within said main body bore and longitudinally locking said weight bar assembly in place;

whereby rotation of said threaded shaft in a second direction moves said threaded nut assembly longitudinally upward along said threaded shaft, said push rod moving upward, said operating rod moving upward under bias of a spring to a second, upper position, wherein said operating rod is above said grooves, wherein said grooves move radially inward and out of engagement with said grooves, said said weight bar assembly thereby free to move downward and force said flowable material out of said cavity.

6. The dump bailer of claim 5, wherein said rotary drive means comprises an electric motor.

* * * * *